US011616304B2

(12) United States Patent
Martel et al.

(10) Patent No.: US 11,616,304 B2
(45) Date of Patent: Mar. 28, 2023

(54) SPIRAL SEGMENT ANTENNA

(71) Applicant: OFFICE NATIONAL D'ETUDES ET DE RECHERCHES AÉROSPATIALES, Palaiseau (FR)

(72) Inventors: Cédric Martel, Pechabou (FR); Jérôme Massiot, Moncoutant (FR); Olivier Pascal, Frouzins (FR); Nathalie Raveu, Ramonville Saint Agne (FR)

(73) Assignee: OFFICE NATIONAL D'ETUDES ET DE RECHERCHES AÉROSPATIALES, Palaiseau (FR)

( * ) Notice: Subject to any disclaimer, the term of this patent is extended or adjusted under 35 U.S.C. 154(b) by 211 days.

(21) Appl. No.: 17/275,862

(22) PCT Filed: Sep. 6, 2019

(86) PCT No.: PCT/EP2019/073830
§ 371 (c)(1),
(2) Date: Mar. 12, 2021

(87) PCT Pub. No.: WO2020/053090
PCT Pub. Date: Mar. 19, 2020

(65) Prior Publication Data

US 2022/0045430 A1 Feb. 10, 2022

(30) Foreign Application Priority Data

Sep. 13, 2018 (FR) ..... 18 00953

(51) Int. Cl.
*H01Q 11/08* (2006.01)
*H01Q 5/25* (2015.01)
*H01Q 13/10* (2006.01)

(52) U.S. Cl.
CPC ..... *H01Q 11/08* (2013.01); *H01Q 5/25* (2015.01); *H01Q 13/10* (2013.01)

(58) Field of Classification Search
CPC ..... H01Q 11/08; H01Q 13/10
See application file for complete search history.

(56) References Cited

FOREIGN PATENT DOCUMENTS

EP 2690707 A1 * 1/2014 ..... H01Q 1/36

OTHER PUBLICATIONS

Massiot et al., "Self Matched Spiral Printed Antenna with Unidirectional Pattern", 7th European Conference on Antennas and Propagation (EuCAP), IEEE, 2013, pp. 1237-1240 (4 total pages).
International Search Report for PCT/EP2019/073830 dated Nov. 21, 2019, 4 pages.

(Continued)

*Primary Examiner* — Dieu Hien T Duong
(74) *Attorney, Agent, or Firm* — Nixon & Vanderhye

(57) ABSTRACT

An antenna (100) for emitting radiation from at least one electromagnetic traveling wave which propagates along a guide path is designed to reduce reflection of the traveling wave likely to occur at the end of the guide path. To this purpose, the guide path has at least one portion in the form of a spiral segment (11, 12), which is connected to another portion of the guide path in the form of a loop (13). Gain in the antenna's reflection coefficient can be obtained in this manner, which is effective in particular near a lower frequency limit of a transmission band of the antenna.

20 Claims, 1 Drawing Sheet

(56) References Cited

OTHER PUBLICATIONS

Written Opinion of the ISA for PCT/EP2019/073830 dated Nov. 21, 2019, 7 pages.
Lasser et al., "A Spiral Antenna for Amplitude-Only Direction Finding", 2017 IEEE International Symposium on Antennas and Propagation & USNC/URSI National Radio Science Meeting, IEEE, Jul. 9, 2017, pp. 927-928 (2 total pages).
Liu et al., "A Novel Compact Archimedean Spiral Antenna with Gap-loading", Progress in Electromagnetics Research Letters, 2008, vol. 3, pp. 169-177 (9 total pages).
Seo, "Comparison of slotline characteristics" Cahloun: Institutional Archive of the Naval Postgraduate School, Thesis and Dissertation Collection, Jun. 1990, 53 pages, <http://hdl.handle.net/10945/34829>.
Volakis et al., "A Broadband Cavity-Backed Slot Spiral Antenna", IEEE Antennas and Propagation Magazine, Dec. 2001, vol. 43, No. 5.
Jeon et al., "Band-Notched UWB Equiangular Spiral Antenna", IEEE Antennas and Propagation Society International Symposium (APSURSI), Jul. 6-11, 2014, pp. 1323-1324.
Dahalan et al. "Archimedean Spiral Antenna With Band-Notched Characteristics", Progress in Electromagnetics Research C, 2013, vol. 37, pp. 83-94.
Nakano et al., "Cavity-backed Archimedean spiral antenna with strip absorber", IET Microwaves Antennas & Propagation, 2008, vol. 2, No. 7, pp. 725-730.
IEEE Transactions on Antennas and Propagation, vol. 50, No. 1, Jan. 2002, pp. 82-85.

* cited by examiner

FIG. 1
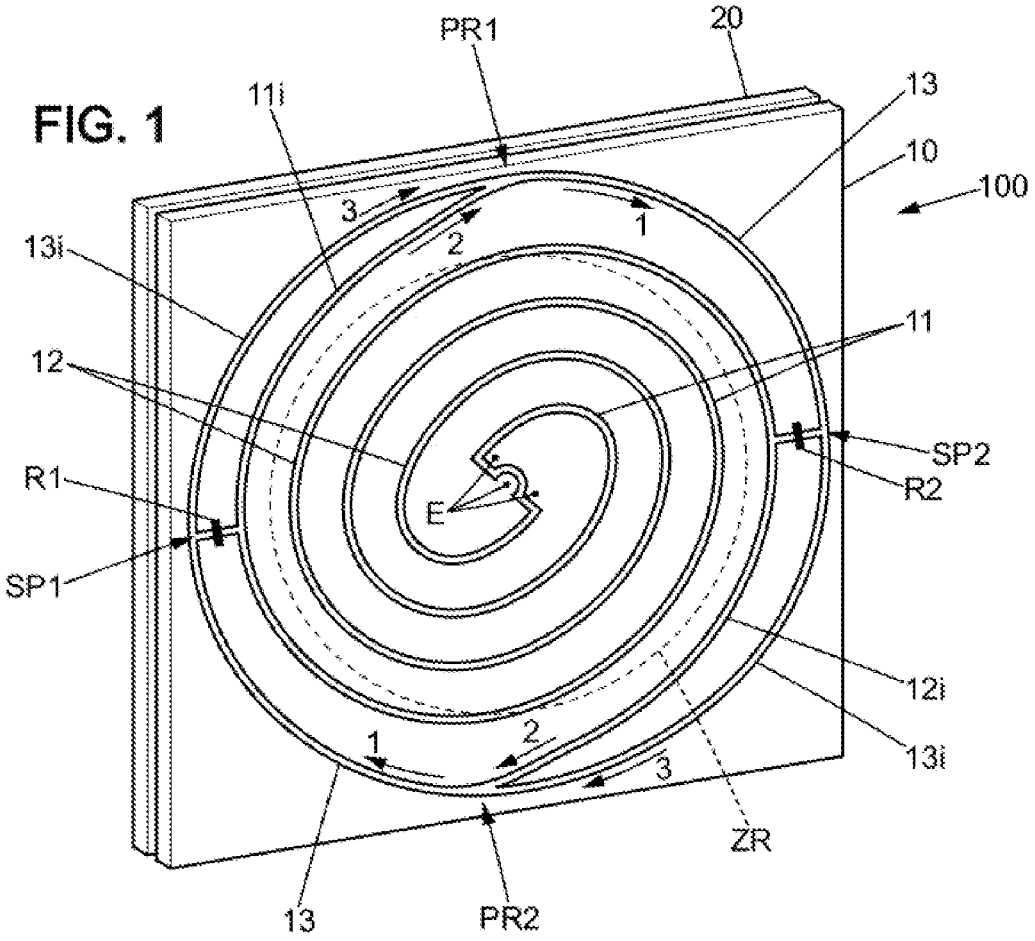
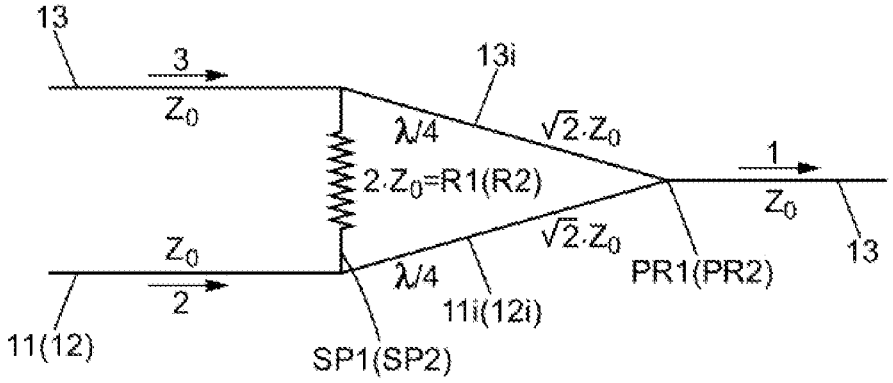
FIG. 2

SPIRAL SEGMENT ANTENNA

CROSS-REFERENCE TO RELATED APPLICATIONS

This application is the U.S. national phase of International Application No. PCT/EP2019/073830 filed Sep. 6, 2019 which designated the U.S. and claims priority to FR 18 00953 filed Sep. 13, 2018, the entire contents of each of which are hereby incorporated by reference.

TECHNICAL FIELD OF THE INVENTION

The present invention relates to an antenna with one or more spiral segment(s) for emitting radiation, in particular radiofrequency (RF) radiation with frequency which may be between 300 MHz (megahertz) and 30 GHz (gigahertz). It may relate in particular to an antenna of the "ultra-wide-band" type, or UWB. In a known manner, a UWB antenna emits radiation of a determined frequency mainly from a restricted zone of this antenna, which is called the radiative zone for the frequency considered. This radiative zone varies depending on the frequency of the radiation emitted, and therefore depending on the frequency of each spectral component of the antenna feed signal.

More precisely, an antenna as considered in this description comprises at least one guide path for a traveling electromagnetic wave, from an electrical feed input to which the feed signal is applied. The radiative zones associated with different values of the frequency of the emitted radiation are distributed along the guide path of the traveling wave, depending on the shape of this path. In the following, "radiation" will be used to refer to electromagnetic radiation which is emitted by the antenna and which propagates in free space outside the antenna, for the purpose of transmitting signals over long distances. In contrast, the term "traveling wave" will denote the electromagnetic wave which propagates along the guide path of the antenna, being confined to this path. We will then call the "effective wavelength" of this traveling wave, its spatial period along the guide path, taking into account the constitution of the antenna, the electrical and dielectric parameters of the materials of which it is composed, and the possible presence of a reflective metal plate which is intended to limit the field of emission of the antenna to a half-space, with solid angle of $2\pi$ steradians.

BACKGROUND OF THE INVENTION

In a known manner, for an antenna whose guide path is in the form of a spiral starting from a feed signal input located at the center of this spiral, the radiative zone which corresponds to the frequency value f is approximately superimposed on the circle which is concentric with the spiral and whose circumference length is a multiple of the effective wavelength of the traveling wave.

However, when the traveling wave reaches the outer end of the spiral guide path, it is at least partially reflected and the returning traveling wave again emits radiation. This delayed additional emission then partly interferes with the main radiation which is simultaneously emitted from the traveling wave which is propagating from the feed input towards the end of the guide path. To avoid this interference, it has been proposed to provide an absorbing material at the outer end of the spiral guide path, to absorb the traveling wave and thereby reduce the amplitude of its reflection. However, this results in a reduction in the transmission efficiency of the antenna, which affects in particular the frequency values whose radiative zones are located at the periphery of the spiral. These frequency values are located at the beginning of the antenna's transmission band, towards its lower frequency limit.

In addition, the article entitled "Self Matched Spiral Printed Antenna with Unidirectional Pattern", by J. Massiot et al., 7th European Conference on Antennas and Propagation (EuCAP), 2013, IEEE, pp. 1237-1240, proposes reducing the reflection of the traveling wave on the outer end of each portion of the spiral-shaped guide path by providing an electrical resistor which connects the last two turns of this portion of the spiral path. This electrical resistor is placed at a distance from the outer end of the spiral path portion which is equal to a quarter of an effective wavelength value of the traveling wave, for a frequency value within the transmission band of the antenna. This solution is not optimal, however, and is not satisfactory for certain applications which require a good transmission efficiency of the antenna extending to the start of its transmission band, in other words for frequency values that are close to the lower limit of the antenna's transmission band, expressed in terms of frequency.

Based on this situation, one object of the invention consists of improving a spiral antenna of the type which has just been described, in order to increase its transmission efficiency at the start of the transmission band.

To achieve this or other objects, the invention provides a novel antenna for emitting radiation from at least one electromagnetic traveling wave which propagates along a guide path determined by a structure of the antenna, this guide path forming a transmission line dedicated to the traveling wave and having at least one path portion in the form of a spiral segment extending to a terminal end of this spiral segment. In other words, the antenna of the invention can be of the ultra-wideband type.

SUMMARY OF THE INVENTION

According to the invention, the guide path further comprises a continuous loop which surrounds each spiral segment, and the terminal end of each spiral segment is connected to the loop at a connection point of this spiral segment. Thus, an electrical signal which is transmitted to a feed input of the antenna produces a traveling wave which propagates along each spiral segment, then is transmitted to the loop at the connection point of this spiral segment. The portion of the traveling wave that is transmitted to the loop at each connection point then participates in the production of radiation. In other words, the loop constitutes at least a portion of a radiative zone of the antenna. In addition, this radiative zone corresponds to frequency values which are close to the lower limit of the antenna's transmission band, expressed in terms of frequency. The performance of the antenna at the start of the transmission band is thus improved.

According to additional features of the invention, intended to further reduce the portion of the traveling wave that is reflected at each connection point:

- the antenna further comprises, for each spiral segment, a bridging structure which is arranged to connect, for the transmission of the traveling wave and in addition to the connection point, this spiral segment to the loop upstream of the connection point relative to the propagation direction of the traveling wave along the spiral segment; and
- for each spiral segment which is thus provided with a bridging structure, two lengths of the guide path between the bridging structure and the connection point, when they are respectively measured along the spiral segment and along the loop, are each equal to one-fourth, within +/−20%, of a same effective wavelength value of the traveling wave, which corresponds to a frequency value within the transmission band of the antenna.

Preferably, the following additional features may be implemented:

/1/ each spiral segment may be connected tangentially to the loop, or roughly tangentially to the loop, at the connection point of this spiral segment. The transmission of the traveling wave from the spiral segment to the loop can thus be improved;

/2/ the effective wavelength of the traveling wave which serves as a reference for the two lengths of the guide path between the bridging structure and the connection point, may be comprised between 0.75/n times and 1.25/n times the length of the loop, n being a positive integer;

/3/ the bridging structure may have an impedance value which is comprised between 1 time and 3 times, preferably between 1.75 times and 2.25 times, a characteristic impedance value common to the spiral segment and the loop out of respective intermediate portions of the spiral segment and of the loop, which are between the bridging structure and the connection point, these impedance values being effective for the traveling wave; and /4/ the intermediate portions of the spiral segment and of the loop may have respective characteristic impedance values which are between $0.5\times2^{1/2}$ times and $1.5\times2^{1/2}$ times, preferably between $0.75\times2^{1/2}$ times and $1.25\times2^{1/2}$ times, the characteristic impedance value common to this spiral segment and to the loop out of the intermediate portions.

When these additional features /2/ to /4/ are all implemented, the connection of the spiral segment to the loop forms a Wilkinson divider, which is arranged to be run along in a wave-joining direction by the traveling wave transmitted by this spiral arm.

When the effective wavelength of the traveling wave which serves as a reference for the two lengths of the intermediate portions is between 0.75 and 1.25 times the length of the loop, the connection of each spiral segment to the loop is sized to increase transmission efficiency of the antenna near the lower limit of its transmission band, expressed in terms of frequency.

It is possible for the antenna to be structured to define several guide path portions which are identical and each in the form of a spiral segment. Each spiral segment extends to a terminal end where it connects to the loop separately from the other spiral segments. Then the antenna may be configured so that all the guide path portions in spiral segments simultaneously transmit respective traveling waves to the loop.

Furthermore, for such a configuration with several spiral segments which feed the loop simultaneously with traveling waves, each spiral segment may be connected to the loop tangentially at the corresponding connection point. Furthermore, it may also be connected to the loop by a respective bridging structure, separately from each other spiral segment, and each spiral segment with the corresponding bridging structure can advantageously reproduce the features which have been indicated above, independently of every other spiral segment.

In various embodiments of the invention, the following other additional features may also be implemented, separately or with several of them combined:

the loop may be circular;

each path portion may connect the feed input of the antenna to the loop, while having the shape of a spiral segment from the feed input of the antenna to the loop;

each path portion may be in the form of an Archimedean spiral segment, including in a continuous manner from the feed input of the antenna to the loop; and the antenna may have a wire antenna configuration, but preferably it has a slot antenna configuration which is formed in a first metal surface. In the latter case, it may further comprise a second metal surface which is parallel to the first metal surface, electrically insulated from the latter, and arranged near it so that the radiation is restrictively emitted by the antenna with an emission direction that is oriented from the second metal surface towards the first metal surface.

BRIEF DESCRIPTION OF THE DRAWINGS

Other features and advantages of the invention will be apparent from the following description of some non-limiting embodiments, with reference to the accompanying drawings, in which:

FIG. 1 is a perspective view of an antenna according to the invention; and

FIG. 2 is an equivalent circuit diagram of a connection that is used in the antenna of FIG. 1.

DETAILED DESCRIPTION OF INVENTION EMBODIMENTS

For clarity, the dimensions of the elements shown in FIG. 1 do not correspond to actual dimensions nor to actual dimensional ratios. In addition, identical references indicated in both figures designate identical elements or elements which have identical functions.

In accordance with FIG. 1, an antenna 100 of the invention is formed in a first metal surface, for example in a metal plate 10. It is composed of slot segments which are arranged relative to each other to form an antenna of the ultra-wideband type. The antenna 100 may comprise several identical spiral segments which each extend from a feed input E for supplying the antenna with an electrical signal. For example, the antenna 100 comprises two spiral segments 11 and 12, which are intended to be supplied with opposite or identical electric currents at the input E, depending on the desired mode of radiation. The feed input E is therefore located at the starting point of each spiral segment 11, 12, and the two spiral segments 11 and 12 alternately intersect centrifugal radial directions originating from the location of the feed input E.

According to the invention, the antenna 100 comprises an additional slot segment 13 in the form of a loop which surrounds the spiral segments. For clarity, the additional slot segment 13 is referred to directly as a loop throughout the remainder of this description, and each spiral-shaped slot segment is referred to as a spiral segment. Preferably, the loop 13 is circular. Spiral segment 11 is connected to the loop 13 at connection point PR1, and spiral segment 12 is connected to the loop 13 at connection point PR2.

In the remainder of this description, it will be assumed that the antenna 100 has only two spiral segments, but it is understood that it can have any number of them: one, three, four, etc. In light of the description which follows, those skilled in the art will understand that when several spiral segments are connected to the loop 13 at connection points which are distributed along this loop 13, these spiral segments must be supplied with respective electric currents, at the feed input E, which are out of phase with respect to one another in a manner which is consistent with the distribution of the connection points on the loop 13. In the case of the antenna shown in FIG. 1, the configuration of the feed input E ensures that the two spiral segments 11 and 12 are supplied with respective electric currents which are opposite, and the two connection points PR1 and PR2 are diametrically opposed on the loop 13.

Then, each slot segment 11-13 constitutes a guide path portion for a traveling electromagnetic wave, this wave comprising variable electric currents which appear on the edges of the slot. Such an antenna 100 produces a coupling between the traveling electromagnetic waves which are guided in the slot segments 11-13, and an electromagnetic radiation external to the antenna 100. This coupling is maximal in areas of the antenna 100 which depend on the frequency value common to the traveling waves guided in the slot segments, and equal to the frequency value of the emitted radiation. These areas are called radiative zones. That one which corresponds to the frequency value f is superimposed on the circle that has the midpoint of the feed input E as its center, and that has a circumference length substantially equal to a multiple of the effective wavelength of each traveling wave having the frequency value f. The reference ZR designates such radiative zone, which is indicated with dotted lines in FIG. 1.

The shape of the spiral segments may be selected according to the efficiency profile that is desired for the antenna 100 within its spectral band of transmission. For example, each slot segment may have an Archimedean spiral shape, whereby the radial distance increases linearly with the angle of the polar coordinate.

The loop 13 is supplied with traveling waves by the two spiral segments 11 and 12 at the connection points PR1 and PR2, so that a resulting traveling wave propagates along the loop 13 when an electrical signal is injected into the two spiral segments 11 and 12 at the feed input E. The loop 13 then constitutes a radiative zone for a frequency value of the emitted radiation which is close to the lower limit of the transmission band of the antenna 100, since it surrounds the spiral segments 11 and 12.

For reducing a reflection which could affect the traveling wave guided by each spiral segment 11, 12 at the corresponding connection point PR1 or PR2, it is advantageous that each spiral segment 11, 12 be connected to the loop 13 tangentially, or substantially tangentially, with respect to the loop.

For further reducing the reflection which could affect the traveling wave guided by each spiral segment 11, 12 at the corresponding connection point PR1 or PR2, it is also advantageous that this spiral segment 11, 12 be connected to the loop 13 by a Wilkinson divider structure, or by a connection structure whose structural and electrical features are close to those of a Wilkinson divider. Such Wilkinson divider is well known to those skilled in the art, so its efficiency in suppressing reflection does not need to be demonstrated again here. Each Wilkinson divider structure is implemented as indicated in FIG. 2, to bring together the traveling wave which is guided by the spiral segment 11 or 12 and that which is guided by the loop 13. Such a connection structure is now described for spiral segment 11, it being understood that another, separate but identical connection structure is used for each other spiral segment of the antenna 100.

A bridging structure SP1 is added to connect the spiral segment 11 to the loop 13, upstream of the connection point PR1 relative to the propagation direction of the traveling wave guided by the spiral segment 11 and originating from the feed input E. The link formed by the bridging structure SP1 between the spiral segment 11 and the loop 13 is effective for transmitting between them a portion of the traveling wave guided by the spiral segment 11 or the loop 13. For this purpose, and as can be seen in FIG. 1, the bridging structure SP1 may be composed of an additional slot segment which connects the last turn of the spiral segment 11 to the loop 13. This additional slot segment may be oriented radially, and may be short in comparison to the effective wavelength of the traveling wave portion it transmits.

The bridging structure SP1 and the connection point PR1 thus demarcate two intermediate guide path portions: the intermediate portion 11*i* along the spiral segment 11, and the intermediate portion 13*i* along the loop 13. The intermediate portions 11*i* and 13*i* preferably each have a length which is substantially equal to a quarter of a determined effective wavelength value, which is relative to the traveling wave guided in the antenna 100. This effective wavelength value can correspond to the radiation which is mainly emitted by the loop 13 as a radiative zone. Thus, the common value of the length of the two intermediate zones 11*i* and 13*i* may be substantially equal to a quarter of the circumference length of the loop 13. More generally, it may be equal to $L_{13}/(4 \cdot n)$, where $L_{13}$ is the circumference length of the loop 13, and n is a positive integer.

Furthermore, for further reducing the reflection of the traveling wave on the end of the spiral segment 11, the bridging structure SP1 may be designed to produce a determined impedance value for the traveling wave portion that it transmits. To achieve this, the spiral segment 11 and the loop 13 each have the same characteristic impedance value $Z_0$ out of the intermediate portions 11*i* and 13*i*. For example, the respective slot segments which constitute the spiral segment 11 and the loop 13 have geometric, electrical, and dielectric parameters which are identical. From these parameters, a person skilled in the art knows how to determine the characteristic impedance value of a slot segment, for the traveling wave that it transmits. On this subject, one can refer in particular to the thesis entitled "Comparison of slotline characteristics" by Yong Seok Seo, Institutional Archive of the Naval Postgraduate School: Cahloun, Monterey, Calif., June 1990, accessible at the Internet address http: //hdl.handle.net/10945/34829. When the only slot antenna parameter that is varied is the slot width, the characteristic impedance of a slot segment is an increasing function of that slot width. Then, the impedance value of the bridging structure SP1 may advantageously be selected as equal to approximately $2 \times Z_0$. The impedance value which is thus desired for the bridging structure SP1 can be produced by arranging an appropriate electrical resistance R1 between the opposite edges of the additional slot segment of this bridging structure SP1. The electrical resistance R1 may be equal or substantially equal to $2 \times Z_0$. It may consist of a discrete component which is attached to the antenna 100, for example by soldering its two terminals, each to one of the two edges of the additional slot segment of the bridging structure SP1. Alternatively, the electrical resistance R1 may also consist of a segment of resistive film of a commercially available type, which is attached locally between the two edges of the slot.

Again for further reducing the reflection of the traveling wave on the end of the spiral segment 11, the characteristic impedance values of the intermediate portions 11*i* and 13*i*, which are effective for the traveling wave guided by each of them, may be adjusted. Thus, when the spiral segment 11 and the loop 13 each again have the common characteristic impedance value $Z_0$ out of the intermediate portions 11*i* and 13*i*, these latter portions may preferably each have a characteristic impedance value which is substantially equal to $2^{1/2} \times Z_0$. Such an adjustment of the characteristic impedance value can in particular be performed by increasing the slot width in the intermediate portions 11*i* and 13*i*, in comparison to the slot width value common to the spiral segment 11 and to the loop 13 out of the intermediate portions 11*i* and 13*i*.

The adjustments which have just been described, for the impedance of the bridging structure SP1 and for the characteristic impedances of the intermediate portions 11*i* and 13*i*, are performed for the same effective wavelength value as that used to adjust the length of the two intermediate portions 11*i* and 13*i*. Under these conditions, the antenna 100 has a Wilkinson divider structure between the spiral segment 11 and the loop 13. This structure makes it possible to inject traveling wave 2 (see FIGS. 1 and 2) guided by the spiral segment 11, into the loop 13, in order to bring it together with the traveling wave 3 guided by the loop 13 upstream of the bridging structure SP1. This results in traveling wave 1 guided by the loop 13 downstream of the connection point PR1. The traveling wave 2 is then weakly reflected, or is not reflected, in the spiral segment 11, by a destructive interference effect which occurs between the traveling wave portions which are reflected separately at the bridging structure SP1 and at the connection point PR1. This reduction or suppression of reflection is most effective for the traveling wave whose effective wavelength value has been used to adjust the length and characteristic impedance values of the intermediate portions 11*i* and 13*i*, and to adjust the impedance value of the bridging structure SP1.

References PR2, SP2, 12*i* and R2 respectively correspond to references PR1, SP1, 11*i* and R1, for spiral segment 12 in place of spiral segment 11.

A second metal surface, for example another metal plate 20 as shown in FIG. 1, is optional. It is arranged parallel to plate 10, and located at a short distance from the latter while being electrically insulated from it. The function of plate 20 is to limit the emission of radiation by the antenna 100 at the side of plate 10 which is opposite to that of plate 20. Typically, the distance between plates 10 and 20 may be equal to about one-twentieth of the wavelength of the radiation which corresponds to the lowest limit of the transmission band of the antenna, expressed in terms of frequency, and the space between the two plates may be filled with an electrically insulating material that is transparent to radiation. When used, plate 20 is taken into account in determining the effective wavelength values of the traveling waves which are guided in the antenna 100, and in determining the characteristic impedance values of the guide path portions for the traveling waves.

By using the invention, the inventors have obtained a gain of at least 7 dB (decibel), or even of more than 12 dB, in the electrical reflection coefficient of the antenna 100, commonly designated by $S_{11}$ and measured at the feed input E. This gain is effective near the lower frequency limit of the transmission band of the antenna 100.

It is understood that the invention can be reproduced while modifying secondary aspects thereof relative to the embodiments detailed above. In particular, the following features of the antenna can be changed:

- there may be any number of spiral segments which are connected to the loop;
- there may be any number of turns in each spiral segment;
- the antenna may be design ed for any transmission band, while being of the UWB-type or not;
- the spiral segments and the loop may have any shapes, with continuous curvatures or based on rectilinear segments, for example to form spirals and an octagonal loop;
- the antenna may be optimized for an emission frequency such that the length of the loop is equal to an integer greater than one, times the effective wavelength of the traveling wave which corresponds to this frequency; and
- the antenna may be of the wire type.

The invention claimed is:

1. An antenna for emitting radiation from at least one electromagnetic traveling wave which propagates along a guide path determined by a structure of the antenna, the antenna comprising at least one spiral segment and a common feed input located at a starting point of each spiral segment, said guide path forming a transmission line dedicated to the traveling wave and having a path portion following each spiral segment to a terminal end of said spiral segment, each spiral segment alternately intersecting centrifugal radial directions originating from the location of the feed input of said antenna, the guide path further comprising a continuous loop which surrounds each spiral segment, and the terminal end of each spiral segment is connected to the loop at a connection point of said spiral segment, whereby the antenna is configured so that an electrical signal transmitted to the feed input of the antenna produces a traveling wave which propagates along each spiral segment, then is transmitted to the loop at the connection point of said spiral segment, the loop thus constituting at least a portion of a radiative zone of the antenna, wherein the antenna further comprises, for each spiral segment, a bridging structure which is arranged to connect, for the transmission of the traveling wave and in addition to the connection point, said spiral segment to the loop upstream of said connection point relative to the propagation direction of the traveling wave along the spiral segment, and wherein, for said spiral segment, two lengths of the guide path between the bridging structure and the connection point, respectively measured along the spiral segment and along the loop, are each equal to one-fourth, within +/−20%, of a same effective wavelength value of the traveling wave, which corresponds to a frequency value belonging to a transmission band of the antenna.

2. The antenna of claim 1, wherein each spiral segment is connected tangentially to the loop, at the connection point of said spiral segment.

3. The antenna of claim 2, wherein the effective wavelength of the traveling wave which serves as a reference for the lengths of the guide path between the bridging structure and the connection point, respectively measured along the spiral segment and along the loop, is between 0.75/n times and 1.25/n times the length of the loop, n being a positive integer.

4. The antenna of claim 2, wherein the bridging structure has an impedance value comprised between 1 time and 3 times a characteristic impedance value common to the spiral segment and the loop out of respective intermediate portions of said spiral segment and said loop, which are between the bridge structure and the connection point, said impedance value of the bridging structure and said characteristic impedance value being effective for the traveling wave.

5. The antenna of claim 2, structured to define several identical guide path portions each in the form of a spiral segment and extending to a terminal end where said spiral segment is connected to the loop separately from the other spiral segments, and the antenna is configured so that all the guide path portions in the form of spiral segments simultaneously transmit respective traveling waves to the loop.

6. The antenna of claim 2, having a slot antenna configuration which is formed in a first metal surface.

7. The antenna of claim 1, wherein the effective wavelength of the traveling wave which serves as a reference for the lengths of the guide path between the bridging structure and the connection point, respectively measured along the spiral segment and along the loop, is between 0.75/n times and 1.25/n times the length of the loop, n being a positive integer.

8. The antenna of claim 7, wherein the bridging structure has an impedance value comprised between 1 time and 3 times a characteristic impedance value common to the spiral segment and the loop out of respective intermediate portions of said spiral segment and said loop, which are between the bridge structure and the connection point, said impedance value of the bridging structure and said characteristic impedance value being effective for the traveling wave.

9. The antenna of claim 7, structured to define several identical guide path portions each in the form of a spiral segment and extending to a terminal end where said spiral segment is connected to the loop separately from the other spiral segments, and the antenna is configured so that all the guide path portions in the form of spiral segments simultaneously transmit respective traveling waves to the loop.

10. The antenna of claim 7, having a slot antenna configuration which is formed in a first metal surface.

11. The antenna of claim 1, wherein the bridging structure has an impedance value comprised between 1 time and 3 times a characteristic impedance value common to the spiral segment and the loop out of respective intermediate portions of said spiral segment and said loop, which are between the bridge structure and the connection point, said impedance value of the bridging structure and said characteristic impedance value being effective for the traveling wave.

12. The antenna of claim 11, wherein the intermediate portions of the spiral segment and of the loop have respective characteristic impedance values which are each between $0.5\times2^{1/2}$ times and $1.5\times2^{1/2}$ times the characteristic impedance value common to said spiral segment and to the loop excluding said intermediate portions.

13. The antenna of claim 12, structured to define several identical guide path portions each in the form of a spiral segment and extending to a terminal end where said spiral segment is connected to the loop separately from the other spiral segments, and the antenna is configured so that all the guide path portions in the form of spiral segments simultaneously transmit respective traveling waves to the loop.

14. The antenna of claim 12, having a slot antenna configuration which is formed in a first metal surface.

15. The antenna of claim 11, structured to define several identical guide path portions each in the form of a spiral segment and extending to a terminal end where said spiral segment is connected to the loop separately from the other spiral segments, and the antenna is configured so that all the guide path portions in the form of spiral segments simultaneously transmit respective traveling waves to the loop.

16. The antenna of claim 11, having a slot antenna configuration which is formed in a first metal surface.

17. The antenna of claim 1, structured to define several identical guide path portions each in the form of a spiral segment and extending to a terminal end where said spiral segment is connected to the loop separately from the other spiral segments, and the antenna is configured so that all the guide path portions in the form of spiral segments simultaneously transmit respective traveling waves to the loop.

18. The antenna of claim 17, wherein each spiral segment is connected to the loop by a respective bridging structure, separately from each other spiral segment, and each spiral segment with the corresponding bridging structure reproduces the features of any one of claims 1 to 12, independently of every other spiral segment.

19. The antenna of claim 1, having a slot antenna configuration which is formed in a first metal surface.

20. The antenna of claim 19, further comprising a second metal surface which is parallel to the first metal surface, electrically insulated from said first metal surface, and arranged near said first metal surface so that the radiation is restrictively emitted by said antenna with an emission direction that is oriented from the second metal surface towards the first metal surface.

* * * * *